United States Patent [19]

Ikeda et al.

[11] Patent Number: 5,034,310

[45] Date of Patent: Jul. 23, 1991

[54] SILVER HALIDE COLOR PHOTOGRAPHIC PHOTOSENSITIVE MATERIAL

[75] Inventors: Hiroshi Ikeda, Hachioji; Yoshitaka Yamada, Hino; Toshihiko Yagi, Shiroyama, all of Japan

[73] Assignee: Konica Corporation, Tokyo, Japan

[21] Appl. No.: 422,066

[22] Filed: Oct. 16, 1989

[30] Foreign Application Priority Data

Oct. 18, 1988 [JP] Japan ..... 63-262462

[51] Int. Cl.[5] ..... G03C 1/46

[52] U.S. Cl. ..... 430/505; 430/506

[58] Field of Search ..... 430/506, 505

[56] References Cited

U.S. PATENT DOCUMENTS

| | | | |
|---|---|---|---|
| 3,658,536 | 4/1972 | Wolf | 430/506 |
| 3,663,228 | 5/1972 | Wyckoff | 430/506 |
| 3,843,369 | 10/1974 | Kumai et al. | 96/74 |
| 4,052,213 | 10/1977 | Credner et al. | 430/443 |
| 4,184,876 | 1/1980 | Eeles et al. | 430/505 |
| 4,267,264 | 5/1981 | Lohmann et al. | 430/505 |
| 4,564,587 | 1/1986 | Watanabe et al. | 430/505 |
| 4,599,302 | 7/1986 | Scheerer | 430/506 |
| 4,701,404 | 10/1987 | Iijima et al. | 430/559 |
| 4,724,198 | 2/1988 | Yamada et al. | 430/506 |
| 4,788,133 | 11/1988 | Sauerteig et al. | 430/505 |
| 4,804,619 | 2/1989 | Yamada et al. | 430/505 |

FOREIGN PATENT DOCUMENTS

| | | | |
|---|---|---|---|
| 0155302 | 8/1984 | European Pat. Off. . | |
| 0136603 | 4/1985 | European Pat. Off. . | |
| 0155814 | 9/1985 | European Pat. Off. . | |
| 0234460 | 9/1987 | European Pat. Off. . | |
| 2018341 | 11/1970 | Fed. Rep. of Germany . | |
| 3420173 A1 | 5/1984 | Fed. Rep. of Germany . | |
| 55-34932 | 9/1980 | Japan . | |
| 61-222944 | 5/1986 | Japan . | |
| 62-206542 | 9/1987 | Japan | 430/506 |
| 2138962 | 10/1984 | United Kingdom | 430/506 |

*Primary Examiner*—Charles L. Bowers, Jr.
*Assistant Examiner*—Janis L. Dote
*Attorney, Agent, or Firm*—Finnegan, Henderson, Farabow, Garrett, and Dunner

[57] ABSTRACT

A silver halide color photographic photosensitive material is disclosed. The material comprises a support and coated thereon at least one green sensitive silver halide emulsion layer, at least one red sensitive silver halide emulsion layer, a plurality of blue sensitive silver halide emulsion layers having different photosensitive speed, said material comprising three or more silver halide emulsion layers having substantially the same color sensitivity, wherein a first blue sensitive silver halide emulsion layer is provided on the outermost side from the support, at least one of green sensitive silver halide emulsion layers and at least one of red sensitive silver halide emulsion layers are provided between the first blue sensitive silver halide emulsion layer and a second blue sensitive silver halide emulsion layer with lower photosensitive speed than the first blue sensitive silver halide emulsion layer, and the layer with highest photosensitive speed of said three or more silver halide emulsion layers having substantially the same color sensitivity has a maximum color density of not higher than 1.0.

18 Claims, No Drawings

SILVER HALIDE COLOR PHOTOGRAPHIC PHOTOSENSITIVE MATERIAL

FIELD OF THE INVENTION

This invention relates to a silver halide color photographic photosensitive material high in photosensitive speed and excellent in image quality and, more particularly, to a silver halide color photographic photosensitive material high in photosensitive speed and, at the same time, improved in graininess and capable of providing a high image quality.

BACKGROUND OF THE INVENTION

In recent years, there has been a demand from the photographic industry for a silver halide color photographic photosensitive material high in both photosensitive speed and image quality.

To be more concrete, there has been a great demand for the development of a silver halide color photographic photosensitive material having a high photosensitive speed and excellent image qualities such as image-sharpness, image-graininess and interimage effect, along with the increases in opportunities of taking pictures under the severe conditions of dim light such as in the indoor photography or through a telephoto or zoom lens which is apt to produce a hand-blurring, and with making silver halide color photographic photosensitive materials smaller in picture-frame format.

It is, however, difficult to make both of a high sensitization and an image quality improvement compatible.

First, the following layer arrangements have been known to make a photosensitive speed higher. For example, there has been a layer arrangement so-called a normal layer arrangement comprising a red photosensitive silver halide emulsion layer, a green photosensitive silver halide emulsion layer, and a blue photosensitive silver halide emulsion layer each coated in order over a support, wherein the layer substantially sensitive to the same color, among a part or all of the photosensitive silver halide emulsion layers, is separated into two layers, namely, a high-speed silver halide emulsion layer containing ballasted couplers each capable of developing substantially the same hue—hereinafter referred to as a high-speed emulsion layer—and a low-speed silver halide emulsion layer -hereinafter referred to as a low-speed emulsion layer- and the two layers are made adjacent to each other and all the resulting layer are multicoated on.

According to the above-mentioned normal layer arrangement, the following problems have been raised. When exposing the photosensitive silver halide emulsion layers to light, the exposure of one layer closer than the other layers to the support is absorbed by the other layers relatively far from the support and, in addition to the above, in the course of development, it takes a considerably longer time to diffuse a developer.

In other words, the above-mentioned layer arrangement has been disadvantageous to the high sensitization of the green and red photosensitive silver halide emulsion layers each lying lower than the other emulsion layer, that is closer to the support, because of the loss of the exposure and the delay in the development progress.

On the other hand, there have been well-known techniques in which the layer-coating order of photosensitive silver halide emulsion layers has been changed—hereinafter referred to as a reverse layer arrangement—.

For example, U.S. Pat. No. 3,663,228 discloses the following arrangement;

<a> A unit of low-speed emulsion layers, which is comprised of a red photosensitive silver halide emulsion layer, a green photosensitive silver halide emulsion, and a blue photosensitive silver halide emulsion,—the unit is hereinafter referred to as a low-speed RGB layer unit—, such unit is coated over a support in order from the support side, <b> A unit of high-speed emulsion layers, which is comprised of a red photosensitive silver halide emulsion layer, a green photosensitive silver halide emulsion, and a blue photosensitive silver halide emulsion,—the unit is hereinafter referred to as a high-speed RGB layer unit—, such unit is coated over the above-mentioned low-speed RGB layer unit in order from the support side, so that a double-layered unit arrangement is adopted, and <c> In the double-layered unit arrangement, each of the high-speed and low-speed RGB layer units is separated by an ND filter—a neutral-density filter—.

As is obvious from the fact that such ND filter is necessarily used therein, this technique has not fully satisfied high image quality performance, because this technique has raised no point at all about any high sensitization.

Next, U.S. Pat. No. 3,658,536 discloses a technique in which an exposure loss is tried to be eliminated from a green photosensitive silver halide emulsion layer which exert a great influence on spectral luminous efficiency, by arranging this green sensitive emulsion layer to the surface side farther from the support. The effect of improving graininess cannot satisfactorily be expected from only a layer-replacing arrangement—a reverse layer arrangement—.

In the meantime, the following techniques have been known as to achieve a high sensitization in a reverse layer arrangement.

<A> Japanese Patent Examined Publication No. 55-34932(1980) discloses the following layer arrangement.

<a> Low-speed red and green photosensitive silver halide emulsion layers,—constituted a low-speed RG layer unit—, are coated each over a support in order from the support side, <b> High-speed red and green photosensitive silver halide emulsion layers,—constituted a higH-speed RG layer unit—, are each coated over the low-speed RG layer unit in order from the support side, and <c> As same as in the normal layer arrangement, high-speed and low-speed blue photosensitive silver halide emulsion layers,—constituted a high-low-speed B layer unit—, are each coated over the high-speed RG layer unit.

<B> Japanese Patent Publication Open to Public Inspection (hereinafter referred to as Japanese Patent O.P.I. Publication) No. 61-22294(1986) discloses the following layer arrangement.

In the low-speed RG layer unit of a silver halide color photographic photosensitive material having the above-described layer arrangement <A>, each of the red and green photosensitive silver halide emulsion layers is separated into one layer having a medium-speed and the other having a low-speed.

<C> Japanese Patent O.P.I. Publication No. 59-177551(1984) discloses the following layer arrangement.

A low-speed RGB layer unit and a high-speed RGB layer unit are each coated in order over a support.

<D> Japanese Patent O.P.I. Publication No. 61-72235(1986) discloses the following layer arrangement.

In the above-given Layer arrangement <A>, the maximum color densities each of the red and/or green photosensitive silver halide emulsion layers are within the range of 0.6 to 1.3.

Every silver halide color photographic photosensitive material having the above-mentioned layer arrangement <A>, <C> or <D> may be an effective means for achieving the purposes of making both photosensitive speed and image quality higher, because these photosensitive materials are each arranged with at least one high-speed red photosensitive silver halide emulsion layer between the high-speed green photosensitive emulsion layer and the green photosensitive silver halide emulsion layer having a photosensitive speed lower than that of the high-speed green photosensitive emulsion layer. However, they are still unable to fully satisfy the ultra-high image quality characteristics having been demanded in recent years.

SUMMARY OF THE INVENTION

It is an object of the invention to provide a silver halide color photographic photosensitive material improved in graininess and capable of obtaining a high image quality, with keeping a high photosensitive speed.

The above-mentioned object of the invention can be achieved with a silver halide color photographic photosensitive material comprising a support and coated thereon at least one green sensitive silver halide emulsion layer, at least one red sensitive silver halide emulsion layer, a plurality of blue sensitive silver halide emulsion layers having different photosensitive speed, said material comprising three or more silver halide emulsion layers having substantially the same color sensitivity, wherein a first blue sensitive silver halide emulsion layer is provided on the outermost side from the support, at least one of green sensitive silver halide emulsion layers and at least one of red sensitive silver halide emulsion layers are provided between the first blue sensitive silver halide emulsion layer and second blue sensitive silver halide emulsion layer with lower photosensitive speed than the first blue sensitive silver halide emulsion layer, and the layer with highest photosensitive speed of said three or more silver halide emulsion layers having substantially the same color sensitivity has a maximum color density of not higher than 1.0.

DETAILED DESCRIPTION OF THE INVENTION

In the invention, the term, a high photosensitive emulsion layer, means a layer having the highest photosensitive speed among the silver halide emulsion layers —hereinafter sometimes simply referred to as emulsion layers—having substantially the same color sensitivity and, on the contrary, the term, a low photosensitive emulsion layer, means a layer having the lowest photosensitive speed.

The expression, a plurality of silver halide emulsion layers each having substantially the same color sensitivity, herein means a plurality of silver halide emulsion layers each having substantially the maximum spectral sensitivity in a blue, green or red spectral region. It is not always necessary that the maximum spectral sensitivity wavelengths, λmax, of the plural emulsion layers should strictly be agreed with each other.

In the silver halide color photographic photosensitive materials of the invention, the difference in photosensitive speed between the above-mentioned high speed emulsion layer and the low speed emulsion layer should be within the range of, preferably, 0.2 to 2.0 and, more preferably, 0.4 to 1.2, in terms of log E in which E stands for an exposure. In the case of separating the same color sensitive emulsion layer into plural layers having each different photosensitive speed, a difference in photosensitive speed between the high speed emulsion layer and the emulsion layer having a photosensitive speed next to that of the above-mentioned high speed emulsion layer—hereinafter referred to as a medium speed emulsion layer—should be within the range of, preferably, 0.2 to 1.0 in terms of log E.

Now, the layer arrangements of the silver halide color photographic photosensitive materials of the invention will be detailed.

The afore-described not less than three-layered silver halide emulsion layers each having substantially the same color sensitivity may not always necessarily be arranged to the positions relatively adjacent to each other, but it should be preferable that a high-speed emulsion layer and a medium-speed emulsion layer should be adjacent to each other.

In the silver halide color photographic photosensitive materials of the invention, it is allowed to arrange a non-photosensitive interlayer between the photosensitive emulsion layers. Particularly in the case where photosensitive emulsion layers each having the different color sensitivity are adjacent to each other, it should be preferable to arrange a non-photosensitive interlayer therebetween. It is also allowed that such non-photosensitive interlayers may contain a scavenger material.

In the silver halide color photographic photosensitive materials of the invention, it is allowed to arrange a yellow filter layer thereto. In this case, it should rather be preferable that such a yellow filter layer is to be arranged under the high-, medium- and/or low-speed blue-photosensitive emulsion layers.

The silver halide color photographic photosensitive materials of the invention are each comprised of at least one silver halide emulsion layer comprising not less than three emulsion layers each having substantially the same color sensitivity and, from the viewpoints of the relation between the emulsion layers each having different sensitivities and the image quality, it should be preferable to take a three-layer arrangement.

Here is given some typical examples of the preferable layer arrangements of the photosensitive emulsion layer in the silver halide color photographic photosensitive materials of the invention. It is, however, to be understood that the invention shall not be limited thereto.

In the examples, the layers will be given in order from the layer closer to the support.

<1> Low-speed red-, green-, and blue-photosensitive emulsion layers each, a high-speed red-photosensitive emulsion layer, a medium-speed green-photosensitive emulsion layer, and high-speed green- and blue-photosensitive emulsion layers each;

<2> Low-speed red-, green-, and blue-photosensitive emulsion layers each, a medium-speed red-photosensitive emulsion layer, and high-speed red-, green-, and blue-photosensitive emulsion layers each;

<3> Low-speed red-, green-, and blue-photosensitive emulsion layers each, high-speed red-, and green-photosensitive emulsion layers each, and medium- and high-speed blue-photosensitive emulsion layers each;

<4> Low-speed red-, green-, and blue-photosensitive emulsion layers each, a medium-speed green-photosensitive emulsion layer, and high-speed green-, red-, and blue-photosensitive emulsion layers each;

<5> Low-speed red-, green-, and blue-photosensitive emulsion layers each, a high-speed green-photosensitive emulsion layer, a medium-speed red-photosensitive emulsion layer, and high-speed red-, and blue-photosensitive emulsion layers each;

<6> A three-layer arrangement of a combination of the above-given examples <1>,<2>, a green-photosensitive emulsion layer, and a red-photosensitive emulsion layer;

Similarly, a layer arrangement of the combination of examples <1>, <3>, examples <4>,<5>, examples <1>, <2>, <3>, or examples <3>, <4>, <5>.

The silver halide color photographic photosensitive materials of the invention are to be characterized in having the layer arrangement relating to the invention as described above, being arranged with not less than three emulsion layers each substantially sensitive to the same color, of which a high-speed emulsion layer has a maximum color density of not higher than 1.0. Such maximum color density may be measured in the following method.

A sample is prepared by coating the emulsion applied to the above-mentioned high-speed emulsion layer over to a support. The resulting sample is sufficiently exposed to light—for 30 seconds or longer to daylight when the weather is fine—and is then color-developed in the following processing steps. After then, the density is measured through a status M filter. On the other hand, the density of a multilayered sample is measured after it is exposed to light, developed, and then each layer is peeled off.

| Processing step | Processing time |
|---|---|
| Color developing at 38° C. | 9 min. 45 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |

The compositions of the processing solutions used in the above-mentioned processing steps are the same as given in Example-1.

In the case of a high-speed blue-photosensitive emulsion layer, the maximum color density thereof should be within the range of, preferably, 0.3 to 0.9 and, more preferably, 0.4 to 0.8. In the cases of a high-speed green-photosensitive emulsion layer and a high-speed red-photosensitive emulsion layer, the maximum color density thereof should be within the range of, preferably, 0.2 to 0.8 and, more preferably, 0.3 to 0.6. In the cases of the medium-speed blue-, green- and red-photosensitive emulsion layers, the maximum densities thereof should be within the range of, preferably, 0.3 to 1.5 and, more preferably, 0.5 to 1.0. The methods of controlling such maximum color density include, for example, a method in which the quantity of couplers or silver halide is adjusted.

There is no special limitation to the grain-sizes of photosensitive silver halide applicable to the photosensitive emulsion layers of the invention. However, an average grain-size of the silver halide of high-speed emulsion layers should preferably be within the range of 0.7 to 2.5$\mu$, because it is advantageous not to make present small-sized grains having a light-scattering behavior so as to minimize sharpness-deterioration produced in an emulsion layer positioned underneath the high-speed emulsion layer. It is also preferable that the medium-speed emulsion layers are to have an average grain-size within the range of 0.5 to 1.5$\mu$ and the low-speed emulsion layers, within the range of 0.2 to 1.0$\mu$, respectively.

Silver halides applicable to the invention include any of those applicable to ordinary type silver halide emulsions, such as silver bromide, silver iodobromide, silver iodochloride, silver chlorobromide, and silver chloride. Among them silver iodobromide should preferably be used. The silver halide emulsions applicable to the invention include any of those such as an emulsion comprising silver halide grains having a uniform silver iodide content,—that is so-called a uniformly composed emulsion—, and an emulsion comprising silver halide grains each having not less than two layers having different silver iodide contents,—that is so-called a core/shell type silver halide emulsion—. Among them, the core/shell type silver halide emulsions should preferably be used.

The above-mentioned silver halide grains may be those capable of forming a latent image either mainly on the surfaces thereof or mainly inside thereof.

The above-mentioned silver halide emulsions may have any grain-size distributions. It is also allowed to use the emulsions each having a wide grain-size distribution,—which are so-called polydispersion type emulsions—, or to use the emulsions each having a narrow grain-size distribution, —which are so-called monodispersion type emulsions—, independently or in combination thereof. It is further allowed to use the mixture of polydispersion type and monodispersion type emulsions. It is, however, particularly preferable to use monodispersion type emulsions.

In the invention, it is allowed to use a mixture of not less than two kinds of silver halide emulsions each separately prepared.

The term, a monodispersion type silver halide emulsion, used herein means an emulsion containing silver halide grains, each of which has a grain-size within the range of $\pm 20\%$ of the average grain-size $\gamma$ of the emulsion, in an amount by weight of not less than 60%, preferably, not less than 70% and, more preferably, not less than 80% of the amount by weight of the total silver halide grains of the emulsion.

The term, an average grain-size $\gamma$, used herein is defined as a grain-size $\gamma i$ obtained when maximizing a product $nix\gamma i^3$ in which ni represents a frequency of grain having a grain-size $\gamma i$, provided, a significant figure is up to 3 figures and the smallest figure is to be rounded to the nearest whole number.

The term, a grain-size, used herein means the diameter of a silver halide grain when the grain is a globule, and the diameter of a circular image having the same area as that of the projective image of the grain when the grain is in other shapes than a globule.

The above-mentioned grain-sizes may be obtained in such a manner that grains are photographed after magnifying them 10000 to 50000 times with an electron microscope, and the diameters of the grains printed or the projective areas of the grains are practically measured, provided, the number of grains to be measured are to be not less than 1000 at random.

The particularly preferable high-grade monodispersion type emulsions are those having a grain-size distribution range of not more than 20% and, more preferably, not more than 15%. The above-mentioned grain-size distribution is defined as follows.

$$\frac{\text{Standard deviation of grain-size}}{\text{Average grain-size}} \times 100 = \text{Distribution range (\%)}$$

wherein an average grain-size and a standard deviation of grain-size are to be obtained from the aforedefined $\gamma i$.

It is preferable to add a non-diffusible compound—a diffusible DIR compound—which is capable of releasing a diffusible, development-inhibitive compound upon reaction with the oxidized product of a developing agent, into an emulsion layer relating to the invention and/or a non-photosensitive emulsion layer.

In the above-mentioned diffusible DIR compounds of the invention, the diffusibility of a development inhibitor or a development inhibitor-releasable compound, which is to be split off upon reaction with the oxidized product of a color developing agent, is not less than 0.34 according to the evaluation method described below and, preferably, not less than 0.40.

The above-mentioned diffusibility is evaluated in the following method.

Samples I and II of photosensitive materials are each prepared so as to comprise a transparent support bearing thereon the layer having the following composition.

Sample I

A sample having a green-sensitive silver halide emulsion layer

A gelatin coating solution is so prepared as to contain green-spectrally sensitized silver iodobromide having a silver iodide content of 6 mol % and an average grain-size of 0.48 μm and the following coupler in an amount of 0.07 mols per mol of silver. The resulting coating solution is coated in the amounts of 1.1 g/m$^2$ in terms of silver coated and 3.0 g/m$^2$ in terms of gelatin used. Further, thereon another gelatin coating solution containing silver iodobromide having a silver iodide content of 2 mol % and an average grain-size of 0.08 μm, which is neither chemically sensitized nor spectrally sensitized, is coated in the amounts of 0.1 g/m$^2$ in terms of silver coated and 0.8 g/m$^2$ in terms of gelatin added, to serve as a protective layer.

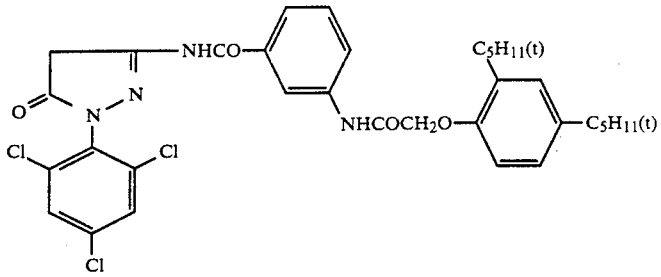

Sample II

The same sample as Sample I, except that silver iodobromide is excluded from the protective layer of Sample I Each layer is added with a gelatin hardener and a surfactant, besides the above-given compositions.

Samples I and II each are exposed to white light through a wedge and are then processed in the following processing steps. These samples are developed with a developer containing various types of development inhibitors in such an amount as to inhibit the photosensitive speed of Sample II to 60%—in terms of a logarithmic expression of $-\Delta \log E = 0.22$—and with the other developer containing no development inhibitor, respectively.

| Processing step at 38° C. | Processing time |
|---|---|
| Color developing | 2 min. 40 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | — |

The compositions of the processing solutions each used in the above processing steps will be given below.

| | |
|---|---|
| <Color developer> | |
| 4-amino-3-methyl-N-ethyl-N-(β-hydroxyethyl)-aniline.sulfate | 4.75 g |
| Sodium sulfite, anhydrous | 4.25 g |
| Hydroxylamine ½ sulfate | 2.0 g |
| Potassium carbonate, anhydrous | 37.5 g |
| Sodium bromide | 1.3 g |
| Trisodium nitrilotriacetate, monohydrate | 2.5 g |
| Potassium hydroxide | 1.0 g |
| Add water to make | 1 liter |
| <Bleacher> | |
| Iron-ammonium ethylenediaminetetraacetate | 100.0 g |
| diammonium ethylenediaminetetraacetate | 10.0 g |
| Ammonium bromide | 150.0 g |
| Glacial acetic acid | 10.0 ml |
| Add water to make | 1 liter |
| Adjust pH with aqueous ammonia to | pH = 6.0 |
| <Fixer> | |
| Ammonium thiosulfate | 175.0 g |
| Sodium sulfite, anhydrous | 8.5 g |
| Sodium metasulfite | 2.3 g |
| Add water to make | 1 liter |
| Adjust pH with acetic acid to | pH = 6.0 |
| <Stabilizer> | |
| Formalin in an aqueous 37% solution | 1.5 ml |
| Konidux, manufactured by Konica Corp. | 7.5 ml |

-continued

| | |
|---|---|
| Add water to make | 1 liter |

Now, a photosensitive speed of Sample I to which no development inhibitor is added is denoted by So; a photosensitive speed of Sample II is denoted by So'; a photosensitive speed of Sample I to which a development inhibitor is added is denoted by $S_I$; and a photosensitive speed of Sample II is denoted by $S_{II}$;

Whereas, a desensitized degree of Sample I is expressed by a formula $\Delta S = So - S_I$; a desensitized degree of Sample II, by $\Delta So = So' - S_{II}$; and a diffusibility, by $\Delta S/\Delta So$; respectively, provided, all the above photosensitive speeds are expressed by a cologarithm,—logE, of an exposure at a density point of a fog-density+0.3.

The diffusibilities of several kinds of development inhibitors are obtained in the above-described method, and the results thereof are shown in the following table-1.

TABLE 1

| Structure | Amount added (mol/l) | Desensitized degree $\Delta S_0$ | Desensitized degree $\Delta S$ | Diffusibility $\Delta S/\Delta S_0$ |
|---|---|---|---|---|
| 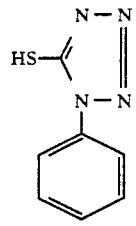 | $1.3 \times 10^{-5}$ | 0.22 | 0.05 | 0.23 |
| 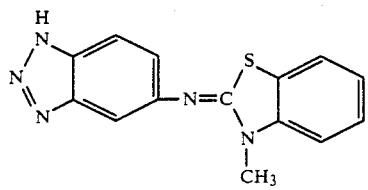 | $1.3 \times 10^{-5}$ | 0.23 | 0.08 | 0.34 |
| 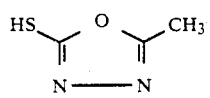 | $2.5 \times 10^{-5}$ | 0.22 | 0.10 | 0.45 |
| 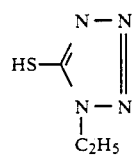 | $3.0 \times 10^{-5}$ | 0.21 | 0.10 | 0.48 |
| 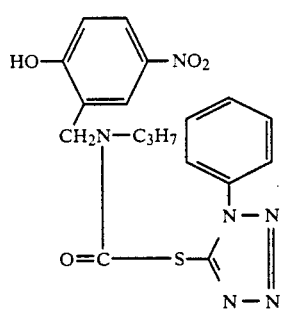 | $1.4 \times 10^{-5}$ | 0.23 | 0.11 | 0.48 |
| 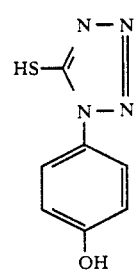 | $2.5 \times 10^{-5}$ | 0.22 | 0.13 | 0.59 |

TABLE 1-continued

| Structure | Amount added (mol/l) | Desensitized degree $\Delta S_0$ | Desensitized degree $\Delta S$ | Diffusibility $\Delta S/\Delta S_0$ |
|---|---|---|---|---|
| 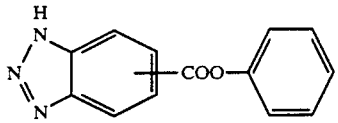 | $3.5 \times 10^{-5}$ | 0.23 | 0.15 | 0.65 |
| 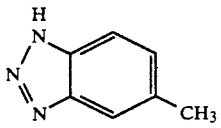 | $4.3 \times 10^{-5}$ | 0.22 | 0.16 | 0.73 |
| 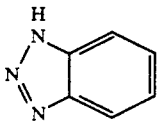 | $1.7 \times 10^{-4}$ | 0.21 | 0.20 | 0.95 |

In the invention, any diffusible DIR compounds may be used regardless of their chemical structures, provided, the groups released therefrom have a diffusibility within the above-given range.

A typical structural formula will be given below.

A—(Y)m Formula D-1 wherein A represents a coupler residual group, m is an integer of 1 or 2 and Y represents either a development inhibitor group or a group capable of releasing a development inhibitor, any of which is bonded to the coupling position of the coupler residual group A and is split off upon reaction of the oxidized product of a color developing agent, said development inhibitor having a diffusibility of not less than 0.34.

In the above-given Formula D-1, Y is typically represented by any one of the following Formulas D-2 through D-19.

Formula D-2

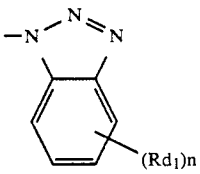

Formula D-3

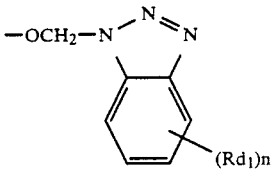

Formula D-4

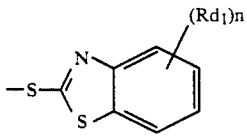

Formula D-5

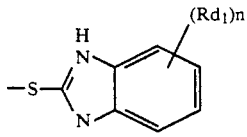

-continued

Formula D-6

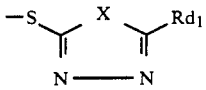

Formula D-7

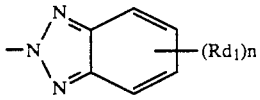

Formula D-8

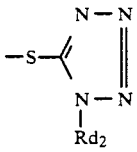

Formula D-9

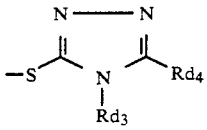

In Formulas D-2 through D-7, $Rd_1$ represents a hydrogen atom, a halogen atom, or a group of alkyl, alkoxy, acylamino, alkoxycarbonyl, thiazolidinylideneamino, aryloxycarbonyl, acyloxy, carbamoyl, N-alkylcarbamoyl, N,N-dialkylcarbamoyl, nitro, amino, N-arylcarbamoyloxy, sulfamoyl, N-alkylcarbamoyloxy, hydroxy, alkoxycarbonylamino, alkylthio, arylthio, aryl, heterocyclic, cyano, alkylsulfonyl, and aryloxycarbonylamino: n is an integer of 0, 1 or 2, provided, when n is 2, each of $Rd_1$ may be the same with or the different. A total number of carbon atoms contained in $Rd_1$ in n number is 0 to 10. In Formula D-6, the number of carbon atoms contained in $Rd_1$ is 0 to 15.

In Formula D-6, X represents an oxygen atom or a sulfur atom.

In Formula D-8, $Rd_2$ represents an alkyl group, an aryl group, or a heterocyclic group.

In Formula D-9, $Rd_3$ represents a hydrogen atom, or an alkyl group, a cycloalkyl group, an aryl group, or a heterocyclic group; and $Rd_4$ represents a hydrogen atom, a halogen atom, or a group of alkyl, cycloalkyl, aryl, acylamino, alkoxycarbonylamino, aryloxycarbonylamino, alkanesulfonamido, cyano, heterocyclic, alkylthio, and amino.

When $Rd_1$, $Rd_2$, $Rd_3$ or $Rd_4$ represents an alkyl group, such alkyl groups inClude those each having a substituent, and they may be either straight-chained or branch-chained.

When $Rd_1$, $Rd_2$, $Rd_3$ or $Rd_4$ represents an aryl group, such aryl groups include those each having a substituent.

When $Rd_1$, $Rd_2$, $Rd_3$ or $Rd_4$ represents a heterocyclic group, such heterocyclic groups include those each having a substituent, and they include, preferably, a 5- or 6-membered single or condensed ring containing at least one hetero atom selected from the group consisting of nitrogen, oxygen and sulfur atoms. These rings may be selected from the group consisting of the following groups, for example, pyridyl, quinolyl, furyl, benzothiazolyl, oxazolyl, imidazolyl, thiaazolyl, triazolyl, benzotriazolyl, imido, and oxazine.

In Formulas D-6 and D-8, $Rd_2$ has the carbon number within the range of 0 to 15.

In Formulas D-9, $Rd_3$ and $Rd_4$ each have the carbon number within the range of 0 to 15.

-TIME-INHIBIT Formula D-10 wherein TIME represents a group capable of coupling to A at the coupling position of A and cleaving upon reaction with the oxidized product of a color developing agent so as to release an INHIBIT group under a suitable control after cleaving from a coupler; and INHIBIT represents a group capable of serving as a development inhibitor upon the above-mentioned releasing reaction, that is, for example, a group represented by the above-given Formulas D-2 through D-9.

In Formula D-10, the -TIME-INHIBIT groups may typically be represented by the following Formulas D-11 through D-19.

Formula D-11

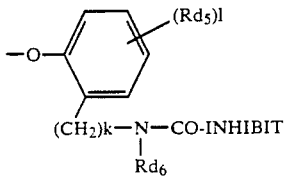

Formula D-12

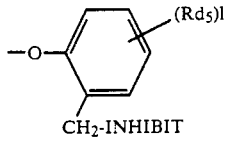

Formula D-13

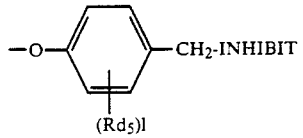

Formula D-14

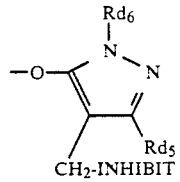

-continued

Formula D-15

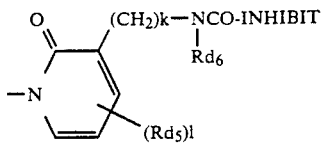

Formula D-16

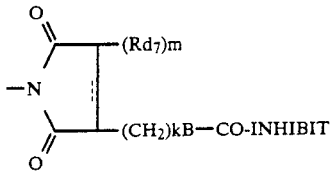

Formula D-17

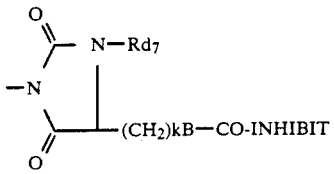

Formula D-18

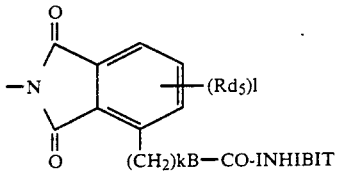

Formula D-19

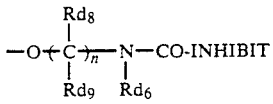

In the above given Formulas D-11 through D-15 and D-18, $Rd_5$ represents a hydrogen atom, a halogen atom, or a group of alkyl, cycloalkyl, alkenyl, aralkyl, alkoxy, alkoxycarbonyl, anilino, acylamino, ureido, cyano, nitro, sulfonamido, sulfamoyl, carbamoyl, aryl, carboxy, sulfo, hydroxy, and alkanesulfonyl. In Formulas D-11 through D-13, D-15, and D-18, the groups represents by $Rd_5$ may be coupled to each other so as to complete a condensed ring. In Formulas D-11, D-14, D-15, and D-19, $Rd_6$ represents a group of alkyl, alkenyl, aralkyl, cycloalkyl, heterocyclic, and aryl. In Formulas D-16 and D-17, $Rd_7$ represents a hydrogen atom, or a group of alkyl, alkenyl, aralkyl, cycloalkyl, heterocyclic, and aryl. In Formula D-19, and $Rd_9$ each represent a hydrogen atom, or an alkyl group such as, preferably, those having 1 to 4 carbon atoms, In Formulas D-11, and D-15 through D-18, k is an integer of 0, 1, or 2. In Formulas D-11 through D-13, D-15, and D-18, 1 is an integer of 1 to 4. In Formula D-16, m is an integer of 1 or 2, provided, when m is 2, $Rd_7$s may be the same with or the different from each other. In Formula D-19, n is an integer of 2 to 4, provided, n number of $Rd_8$ and $Rd_9$ may be the same with or the different from each other. In Formulas D-16 through D-18, B represents an oxygen atom or

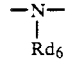

in which $Rd_6$ is synonymous with the $Rd_6$ already defined before. In Formula D-16, represents a single-bond or a double-bond, provided, in the case of a single-bond, m is 2 and in the case of a double-bond, m is 1, and an INHIBIT group is synonymous with those defined in Formulas D-2 through D-9, except the carbon numbers.

In the INHIBIT groups, $R_1$ in a molecule in Formulas D-s through D-7 contains 0 to 32 carbon atoms in total. In Formula D-8, $Rd_2$ contains 1 to 32 carbon atoms. In Formula D-9, $Rd_3$ and $Rd_4$ each contain 0 to 32 carbon atoms in total.

When $Rd_5$, $Rd_6$ and, $Rd_7$ represent an alkyl, aryl, or cycloalkyl group, they include those each having a substituent.

The diffusible DIR compounds include, preferably, those represented by Formula D-2, D-3, or D-10. Among them, the compounds represented by Formula D-10 include, preferably, those having an INHIBIT group represented by Formula D-2 or D-6 particularly when X denoted in Formula D-6 represents an oxygen atom, or those represented by Formula D-8 particularly in which $Rd_2$ represents a hydroxyaryl group or an alkyl group having 1 to 3 carbon atoms.

In Formula D-1, the coupler components represented by A include, for example, a yellow image forming coupler residual group, a magenta image forming coupler residual group, a cyan image forming coupler residual group, and a non-color providing coupler residual group.

The diffusible DIR compounds preferably applicable to the invention include the following compound to which there shall, however, be no special limitation.

Exemplified compounds

D-1

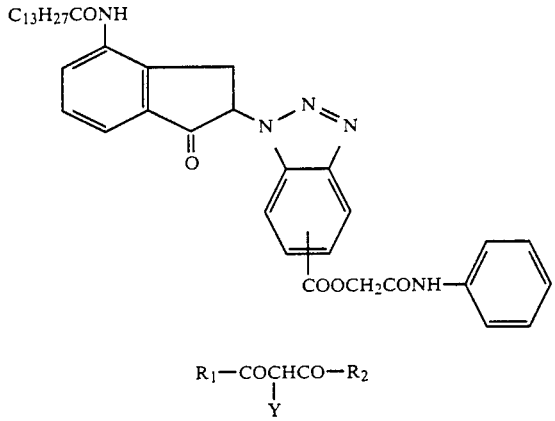

| Exemplified compound No. | $R_1$ | $R_2$ | Y |
|---|---|---|---|
| D-2 | (1) | (1) | (33) |
| D-3 | (2) | (3) | (30) |
| D-4 | (2) | (4) | (30) |
| D-5 | (5) | (6) | (31) |
| D-6 | (2) | (4) | (32) |
| D-7 | (2) | (3) | (32) |
| D-8 | (7) | (8) | (33) |
| D-33 | (2) | (4) | (55) |

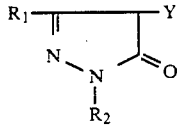

| | | | |
|---|---|---|---|
| D-9 | (9) | (10) | (30) |
| D-10 | (11) | (10) | (30) |
| D-11 | (12) | (7) | (34) |
| D-12 | (12) | (13) | (35) |
| D-13 | (9) | (14) | (36) |
| D-14 | (15) | (16) | (37) |

-continued

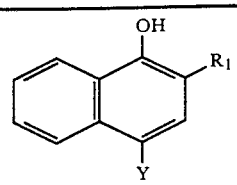

| | | |
|---|---|---|
| D-15 | (17) | (38) |
| D-16 | (17) | (39) |
| D-17 | (18) | (40) |
| D-18 | (19) | (41) |
| D-19 | (18) | (42) |
| D-20 | (18) | (43) |
| D-21 | (18) | (44) |
| D-22 | (18) | (45) |
| D-23 | (18) | (46) |
| D-24 | (20) | (47) |
| D-25 | (20) | (48) |
| D-26 | (21) | (49) |
| D-27 | (21) | (50) |
| D-28 | (21) | (51) |
| D-29 | (22) | (52) |
| D-30 | (18) | (53) |
| D-31 | (18) | (54) |
| D-32 | (22) | (49) |

1 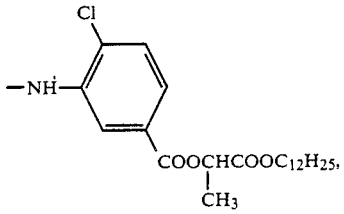

2 $-C(CH_3)_3$,

3 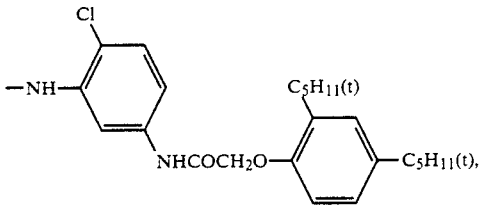

4 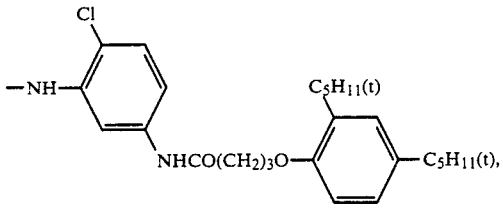

5 $-OCH_3$,

6 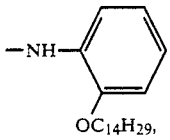

7 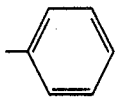

-continued
8 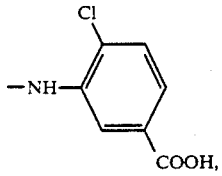
9 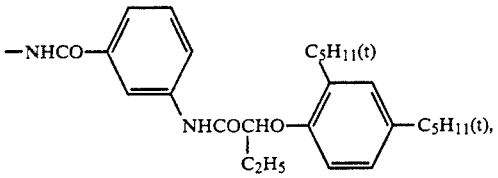
10 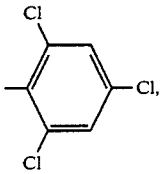
11 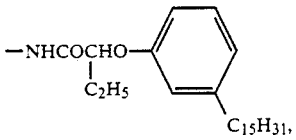
12 $-C_{17}H_{35}$,
13 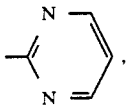
14 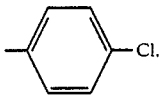
15 $-CH_3$,
16 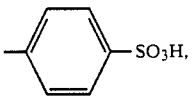
17 $-CONHC_{18}H_{37}$,
18 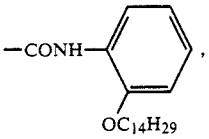
19 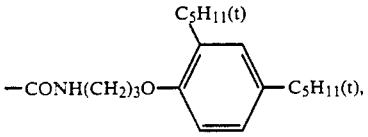
20 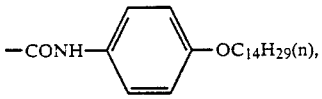
21 $-CONHCH_2CH_2COOH$,
-continued
22 $-CONHCH_2CH_2COOCH_3$,
30 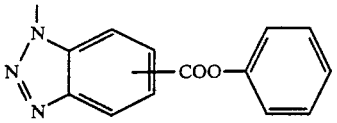
31 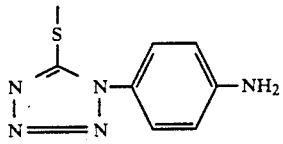
32 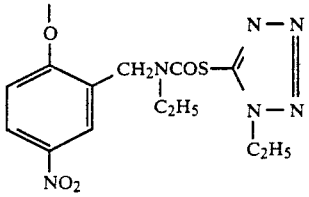
33 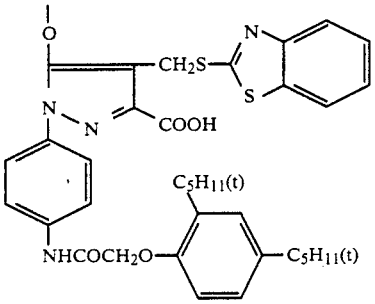
34 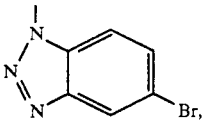
35 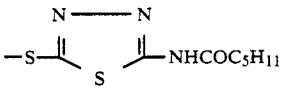
36 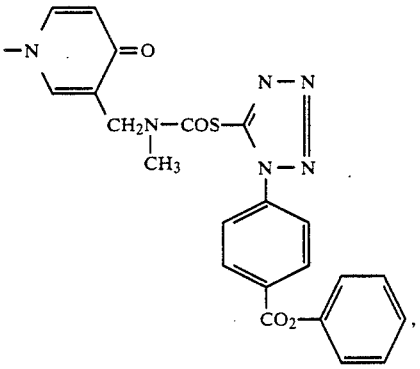
37 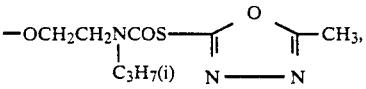

-continued

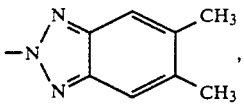

38

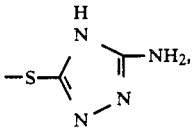

39

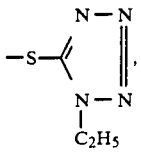

40

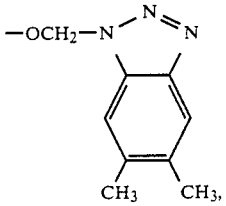

41

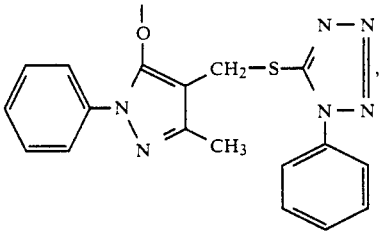

46

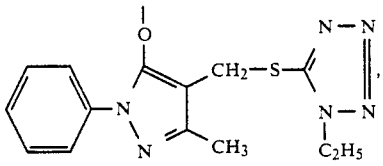

47

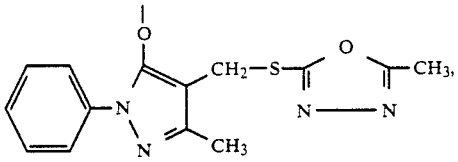

48

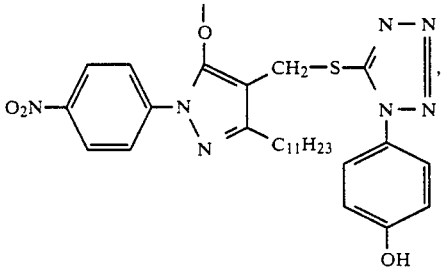

49

-continued

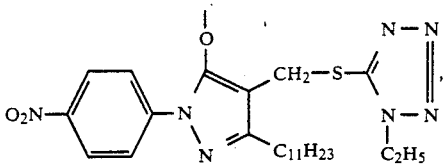

50

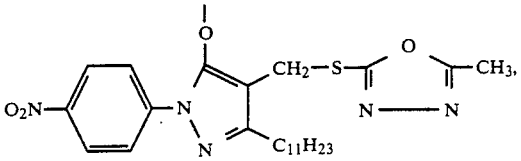

51

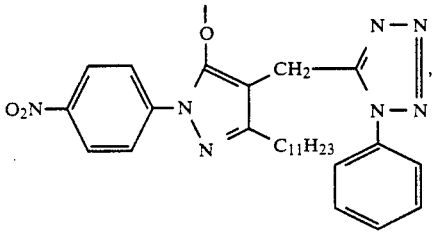

52

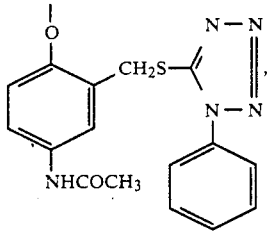

53

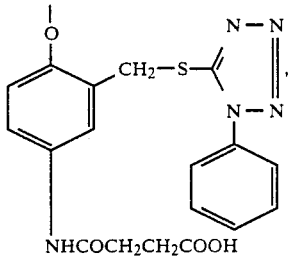

54

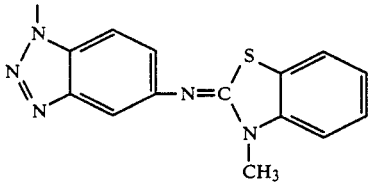

55

Including the above-given compounds, the typical examples of the diffusible DIR compounds applicable to the invention are given in U.S. Pat. Nos. 4,234,678, 3,227,554, 3,617,291, 3,958,993, 4,149,886 and 3,933,500; Japanese Patent O.P.I. Publication Nos. 56837/1982 and 13239/1976; U.S. Pat. Nos. 2,072,363, and 2,070,266; Research Disclosure No. 21228, December, 1981; and so forth.

Such diffusible DIR compounds should be used in an amount within the range of, preferably, 0.0001 to 0.1 mol per mol of silver halide used and, more preferably, 0.001 to 0.05 mol.

Silver halide emulsions, which may be used in the silver halide color photographic light-sensitive materials of the invention, can be chemically sensitized in a conventional method, and can be optically sensitized to a desired spectral wavelength region by a sensitizing dye.

In the silver halide emulsions of the invention, silver halide grains containing a desensitizer in at least one part thereof may be used. For getting a wide exposure latitude, silver halide grains having different average grain-sizes may be used mixedly, but if silver halide grains containing a desensitizer is used in place of low-sensitive silver halide grains having a smaller grain-size, the difference of average grain-sizes can be made smaller without changing the sensitivity of the silver halide grains, moreover, such silver halide grains as those having equal average grain-size and, at the same time, as those having different sensitivities, may be used mixedly.

In other words, by using silver halide grains containing a desensitizer, a wide exposure latitude can be got even when the variation coefficient of the total grains is made small.

Therefore, these silver halide grains having a small variation coefficient under the same circumstances, are preferably used, because the photographic characteristics against any changes on standing and any variations of developing processes may be stabilized.

From the aspect of the production technology, a mixture of silver halide grains having different sensitivities may be chemically sensitized in one and the same batch.

As the desensitizers, various kinds of materials may be used, such as antifoggants, stabilizer, and desentizing dyes, as well as metal ions.

The desensitizing methods include, preferably, a metal ion doping method.

The metal ions applicable to the doping method include, for example, ions of Cu, Cd, Zn, Pb, Fe, Tl, Rh, Bi, Ir, Au, Os, and Pd etc. These metal ions may be used in the form of, for example, the halogeno-complex salts thereof and they may also be used in combination. An AgX suspension system should preferably have a pH of not higher than 5, in the course of doping.

A doping amount of the above-given metal ions depends on the kinds and doping positions of the metal ions, the grain-sizes of silver halide grains, the sensitivities required, and so forth. It is however preferable to dope it in an amount within the range of $10^{-17}$ to $10^{-2}$ mols per mol of AgX and, particularly, $10^{-16}$ to $10^{-4}$ mols.

When such a metal ion is Rh ion, the doping is to be made in an amount within the range of, preferably, $10^{-14}$ to $10^{-2}$ mols and, particularly, $10^{-11}$ to $10^{-4}$ mols.

When selecting one of such metal ions by the kinds, doping positions and doping amount thereof, a variety of sensitivity characteristics may be given to silver halide grains.

When a doping amount is not more than $10^{-2}$ mol per mol of AgX, there may be few of influences on the growth of grains. Therefore, silver halide grains having a narrow grain-size distribution may be prepared even under the same grain growth conditions and, consequently, even when growing the grains in the same batch.

Silver halide grains having different doping requirements arranged for putting them to practical use may be mixed together in a specific proportion by quantity and chemically sensitized in the same batch. Each of such silver halide grains may be subject to the sensitizing effect, depending upon the characteristics thereof, so that a wide-latitude emulsion may be obtained by both of the difference in the sensitivity of each grain and the proportion thereof in the mixture.

To the silver halide emulsions relating to the invention, an antifoggant, a stabilizer, and so forth may be added. As for the binders for the emulsions, gelatin may advantageously be used.

Emulsion layers and other hydrophilic colloidal layers each may be hardened and may contain a plasticizer and a water-insoluble or hardly-soluble synthetic polymer dispersion material that is so-called a latex.

The invention may preferably be applied to color light-sensitive materials such as color negative films, color reversal films, and so forth.

To the emulsion layers of color photographic light-sensitive materials, couplers may be applied.

Besides the above-mentioned couplers, it is also allowed to use a colored coupler having a complementary effect, a competing coupler, and a compound capable of releasing photographically useful fragments such as a development accelerator, developing agent, silver halide solvent, color-toner, layer-hardener, foggant, antifoggant, chemical sensitizer, spectral sensitizer and/or desensitizer, upon coupling reaction with the oxidized product of a developing agent.

Such light-sensitive materials may also be provided with auxiliary layers such as a filter layer, antihalation layer and anti-irradiation layer. The above-mentioned layers and/or emulsion layers may also contain thereinside a dye capable of flowing out of a light-sensitive material or being bleached, in the course of development.

Such light-sensitive materials may also be added with a formalin scavenger, fluorecent whitening agent, matting agent, lubricant, image-stabilizer, surfactant, color-fog inhibitor. development accelerator, development retarding agent, and bleach accelerator.

The supports applicable to the invention include, for example, those made of a sheet of paper laminated with polyethylene or the like, a polyethyleneterephthalate film, a baryta paper, and a cellulose triacetate film.

A dye-image may be formed on of a light-sensitive material of the invention in such a manner that the light-sensitive material is exposed to light and is then processed in a popularly known color photographic treatment.

EXAMPLE

EXAMPLE-1

Now, the following actual examples of the present invention will be described, but the embodiments of the present invention shall not be limited to the examples given herein.

In all of the following examples, the quantity of addition to silver halide photographic light sensitive materials will be given by a quantity per $m^2$, unless otherwise specially stated. And, silver halide and colloidal silver are indicated in terms of silver contents.

On a triacetyl cellulose film support, the layers having the following composition are formed in order from the support side to make multilayered color photographic material samples 1–5.

Sample-1

The first layer: An anti-halation layer

| | |
|---|---|
| Black colloidal silver | |
| Amount of silver coated | 0.2 g |
| Gelatin | 1.7 g |
| Ultra-violet absorbing agent, UV-1 | 0.3 g |
| Colored magenta coupler, CM-1 | 0.2 g |
| High boiling solvent, Oil-1 | 0.15 g |
| High boiling solvent, Oil-4 | 0.15 g |
| High boiling solvent, Oil-3 | 0.2 g |

The second layer: An intermediate layer

| | |
|---|---|
| Gelatin | 1.2 g |

The third layer: The first red sensitive emulsion layer

| | |
|---|---|
| Silver bromoiodide emulsion EM-1 | |
| Amount of silver coated | 1.0 g |
| Silver bromoiodide emulsion EM-2 | |
| Amount of silver coated | 0.5 g |
| Gelatin | 1.3 g |
| Sensitizing dye S-2 | |
| $0.5 \times 10^{-4}$ mol per mol of silver | |
| Sensitizing dye S-3 | |
| $2.0 \times 10^{-4}$ mol per mol of silver | |
| Sensitizing dye S-1 | |
| $2.0 \times 10^{-4}$ mol per mol of silver | |
| Coupler C-2 | 0.07 g |
| Coupler C-1 | 0.3 g |
| Colored cyan coupler CC-1 | 0.07 g |
| High boiling solvent Oil-1 | 0.2 g |

The fourth layer: An intermediate layer

| | |
|---|---|
| Gelatin | 0.8 g |

The fifth layer: A green sensitive emulsion layer

| | |
|---|---|
| Silver bromoiodide emulsion layer EM-1 | |
| Amount of silver coated | 1.0 g |
| Silver bromoiodide emulsion layer EM-2 | |
| Amount of silver coated | 0.5 g |
| Gelatin | 1.4 g |
| Sensitizing dye S-7 | |
| $1.8 \times 10^{-4}$ mol per mol of silver | |
| Sensitizing dye S-6 | |
| $1.3 \times 10^{-4}$ mol per mol of silver | |
| Sensitizing dye S-8 | |
| $9.2 \times 10^{-5}$ mol per mol of silver | |
| Sensitizing dye S-5 | |
| $6.8 \times 10^{-5}$ mol per mol of silver | |
| Sensitizing dye S-4 | |
| $6.2 \times 10^{-4}$ mol per mol of silver | |
| Coupler M-1 | 0.15 g |
| Colored magenta coupler CM-1 | 0.08 g |
| High boiling solvent Oil-2 | 0.23 g |

The sixth layer: An intermediate layer

| | |
|---|---|
| Gelatin | 0.8 g |
| SC-1 | 0.05 g |
| High boiling solvent Oil-3 | 0.05 g |

The seventh layer: The first blue sensitive emulsion layer

| | |
|---|---|
| Silver bromoiodide emulsion EM-1 | |
| Amount of silver coated | 0.8 g |
| Gelatin | 0.6 g |
| Sensitizing dye S-10 | |
| $3 \times 10^{-4}$ mol per mol of silver | |
| Sensitizing dye S-9 | |
| $1 \times 10^{-4}$ mol per mol of silver | |
| Coupler Y-1 | 0.3 g |
| High boiling solvent Oil-3 | 0.3 g |

The eighth layer: An intermediate layer

| | |
|---|---|
| Gelatin | 0.8 g |
| SC-1 | 0.05 g |
| High boiling solvent Oil-3 | 0.05 g |

The ninth layer: The second red sensitive emulsion layer

| | |
|---|---|
| Silver bromoiodide emulsion EM-1 | |
| Amount of silver coated | 1.0 g |
| Silver bromoiodide emulsion EM-3 | |
| Amount of silver coated | 2.0 g |
| Fine-grained silver bromoiodide emulsion (An average grain-size of 0.08μ, an AgI content of 2 mol %) | |
| Amount of silver coated | 0.5 g |
| Gelatin | 2.4 g |
| Sensitizing dye S-2 | |
| $0.2 \times 10^{-4}$ mol per mol of silver | |
| Sensitizing dye S-3 | |
| $1.0 \times 10^{-4}$ mol per mol of silver | |
| Coupler C-2 | 0.2 g |
| Coupler C-1 | 0.05 g |
| Coupler C-3 | 0.10 g |
| SC-1 | 0.05 g |
| High boiling solvent Oil-1 | 0.4 g |

The tenth layer: An intermediate layer

| | |
|---|---|
| Gelatin | 0.8 g |
| SC-1 | 0.07 g |
| Colored magenta coupler CM-1 | 0.04 g |
| High boiling solvent Oil-3 | 0.25 g |

The eleventh layer: The second green sensitive emulsion layer

| | |
|---|---|
| Silver bromoiodide emulsion EM-1 | |
| Amount of silver coated | 0.8 g |
| Silver bromoiodide emulsion EM-3 | |
| Amount of silver coated | 1.6 g |
| Gelatin | 1.6 g |
| Sensitizing dye S-7 | |
| $6.8 \times 10^{-5}$ mol per mol of silver | |
| Sensitizing dye S-6 | |
| $6.7 \times 10^{-5}$ mol per mol of silver | |
| Coupler M-1 | 0.2 g |
| Colored magenta coupler CM-1 | 0.02 g |
| High boiling solvent Oil-2 | 0.2 g |

The twelfth layer: An intermediate layer

| | |
|---|---|
| Fine-grained AgX emulsion (having an average grain-size of 0.08μ, and an AgI content of 2 mol %) | |
| Amount of silver coated | 0.3 g |
| Gelatin | 0.8 g |
| SC-1 | 0.05 g |

-continued

| | |
|---|---|
| High boiling solvent oil-3 | 0.05 g |

The thirteenth layer: The second blue sensitive emulsion layer

| | |
|---|---|
| Silver bromoiodide emulsion EM-1 | |
| Amount of silver coated | 0.7 g |
| Silver bromoiodide emulsion EM-4 | |
| Amount of silver coated | 1.4 g |
| Fine-grained AgX emulsion having an average grain-size of 0.08μ an AgI content of 2 mol % | |
| Amount of silver coated | 0.1 g |
| Fine-grained AgX emulsion (having an average grain-size of 0.3μ and an AgI content of 2 mol %) | |
| Amount of silver coated | 0.1 g |
| Gelatin | 2.1 g |
| Sensitizing dye S-9 | |
| $0.4 \times 10^{-4}$ mol per mol of silver | |
| Sensitizing dye S-11 | |
| $1.2 \times 10^{-4}$ mol per mol of silver | |
| Coupler Y-1 | 0.8 g |
| High boiling solvent Oil-3 | 0.4 g |

The fourteenth layer: The first protective layer

| | |
|---|---|
| Gelatin | 1.5 g |
| Ultra violet absorber UV-1 | 0.1 g |
| Ultra violet absorber UV-2 | 0.1 g |
| Formalin scavenger HS-1 | 0.5 g |
| Formalin scavenger HS-2 | 0.2 g |
| High boiling solvent Oil-1 | 0.1 g |
| Hiqh boiling solvent Oil-4 | 0.1 g |

The fifteenth layer: The second protective layer

| | |
|---|---|
| Gelatin | 0.6 g |
| Alkali-soluble matting agent having an average grain-size of 2μ | 0.12 g |
| Polymethyl methacrylate having an average grain-size of 3μ | 0.02 g |
| Lubricant WAX-1 | 0.04 g |
| Anti-static additive Su-1 | 0.004 g |

To each layer, coating aid Su-2, dispersion aids Su-2 and Su-3, hardeners H-1 and H-2, stabilizer Stab-1, anti-foggants AF-1 and AF-2 and antiseptic DI-1 were added, in addition to the above-mentioned compositions.

Sample-2

From the first layer to the tenth layer, the same materials were used as in Sample-1.

The eleventh layer: The second green sensitive emulsion layer

| | |
|---|---|
| Silver bromoiodide emulsion Em-1 | |
| Amount of silver coated | 0.3 g |
| Silver bromoiodide emulsion Em-5 | |
| Amount of silver coated | 0.8 g |
| Gelatin | 1.1 g |
| Sensitizing dye S-7 $1.0 \times 10^{-4}$ mol per mol of silver | |
| Sensitizing dye S-6 $1.0 \times 10^{-4}$ mol per mol of silver | |
| Sensitizing dye S-8 $1.0 \times 10^{-5}$ mol per mol of silver | |
| Coupler M-1 | 0.04 g |
| Colored magenta coupler CM-1 | 0.01 g |
| High boiling solvent Oil-2 | 0.04 g |

The twelfth layer: The third green sensitive emulsion layer

| | |
|---|---|
| Silver bromoiodide emulsion Em-3 | |
| Amount of silver coated | 1.3 g |
| Gelatin | 1.7 g |
| Sensitizing dye S-7 | |
| $0.7 \times 10^{-4}$ mol per mol of silver | |
| Sensitizing dye S-6 | |
| $0.7 \times 10^{-4}$ mol per mol of silver | |
| Sensitizing dye S-8 | |
| $0.2 \times 10^{-5}$ mol per mol of silver | |
| Coupler M-1 | 0.16 g |
| Colored magenta coupler CM-1 | 0.01 g |
| High boiling solvent Oil-2 | 0.16 g |

From the thirteenth layer to the sixteenth layer, they were the same layers as those from the twelfth layer to the fifteenth layer used in Sample-1.

Sample-3

This was just the same as Sample-2, except that Coupler M-1 and High boiling solvent Oil-2 in the eleventh layer of Sample-2 were added in an amount of 0.12 g each and Coupler M-1 and High boiling solvent Oil-2 in the twelfth layer of Sample-2, in an amount of 0.08 g each, respectively.

Sample-4

This was just the same as Sample-2, except that Coupler M-1 and High boiling solvent Oil-2 in the eleventh layer of Sample-2 were added in an amount of 0.13 g each and Coupler M-1 and high boiling solvent Oil-2 of the twelfth layer in Sample-2, in an amount of 0.08 g each, respectively.

Sample-4

This was just the same as Sample-2, except that Coupler M-1 and High boiling solvent Oil-2 of the eleventh layer of Sample-2 were added and an amount of 0.13 each and Coupler M-1 and high boiling solvent Oil-2 of the twelfth layer of Sample-2, in an amount of 0.07 g each, respectively.

Sample-5

From the first layer to the third layer, they were the same as those from the first layer to the third layer of Sample-1.

The fourth layer: The same as the ninth layer of Sample-1.

The fifth layer: The same as the sixth layer of Sample-1.

The sixth layer: The same as the fifth layer of Sample-1.

The seventh layer: The same as the eleventh layer of Sample-1.

The eighth layer: A yellow filter layer

| | |
|---|---|
| Yellow colloidal silver | 0.1 g |
| SC-1 | 0.1 g |
| High boiling solvent Oil-3 | 0.1 g |
| Gelatin | 0.8 g |

The ninth layer: The same as the seventh layer of Sample-1.

The tenth to twelfth layer: The same as those from the thirteenth layer to the fifteenth layer of Sample-1.

Em-1: Mono-dispersion type emulsion having a low silver iodide content on the surface. An average grain-size: 0.8μ; An average silver iodide content: 8.0%

Em-2: Mono-dispersion type emulsion having a low silver iodide content on the surface. An average grain-size: 0.4μ; An average silver iodide content: 7.0%

Em-3: Mono-dispersion type emulsion having a low silver iodide content on the surface. An average grain-size: 1.5μ; An average silver iodide content: 6.4%

Em-4: Mono-dispersion type emulsion having a low silver iodide content on the surface. An average grain-size: 2.0μ: An average silver iodide content: 7.0%

Em-5: Mono-dispersion type emulsion having a low silver iodide content on the surface. An average grain-size: 1.0μ: An average silver iodide content: 8.0%

S-1

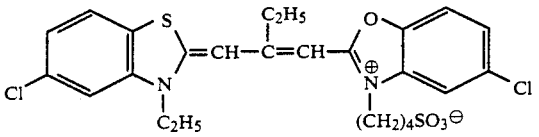

S-2

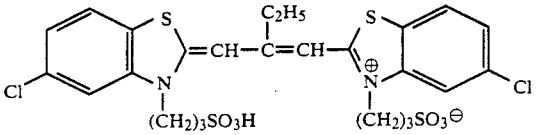

S-3

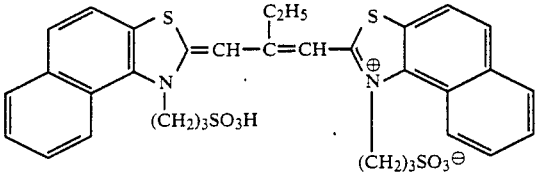

S-4

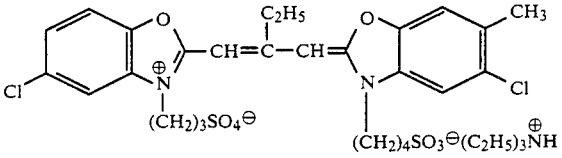

S-5

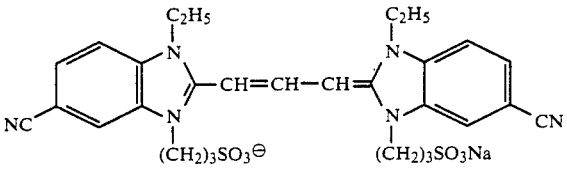

S-6

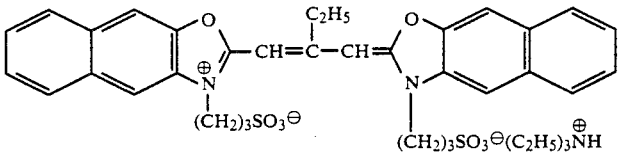

S-7

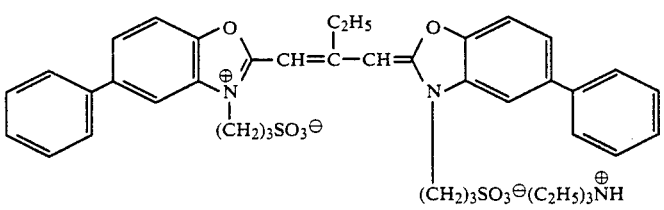

S-8

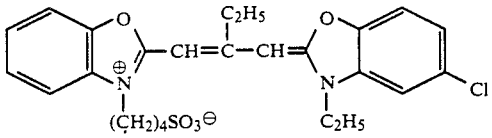

-continued
S-9
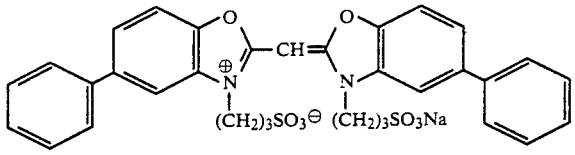
S-10
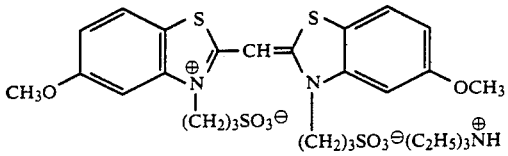
S-11
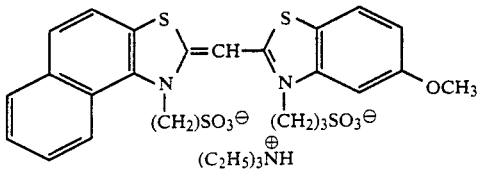
C-1
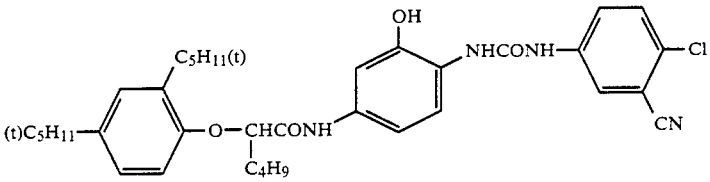
C-2
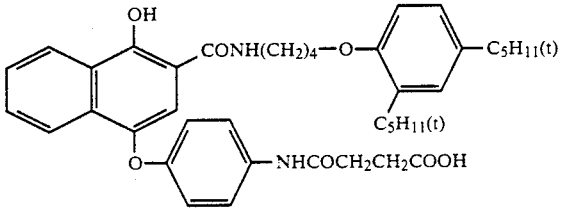
C-3
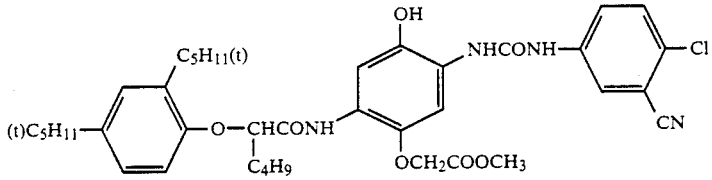
M-1
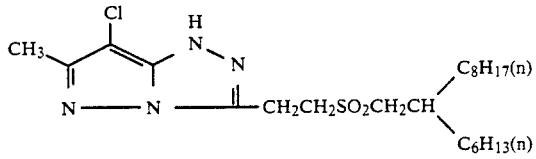
Y-1
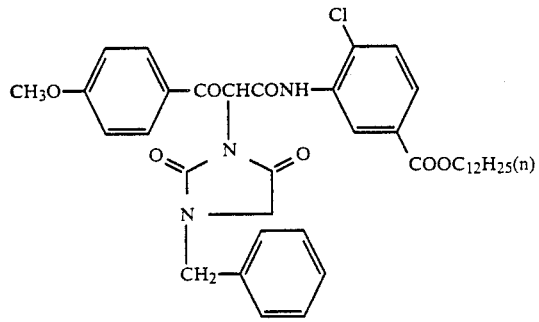

-continued
CC-1
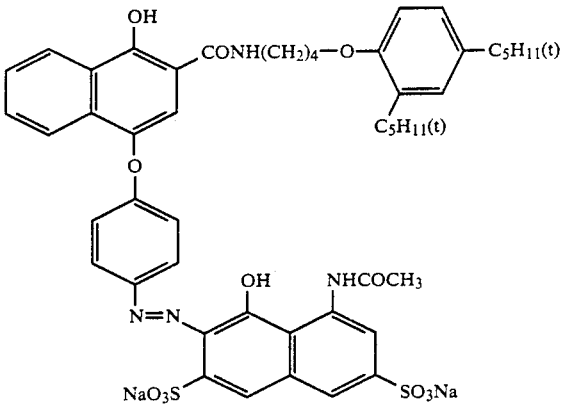
CM-1
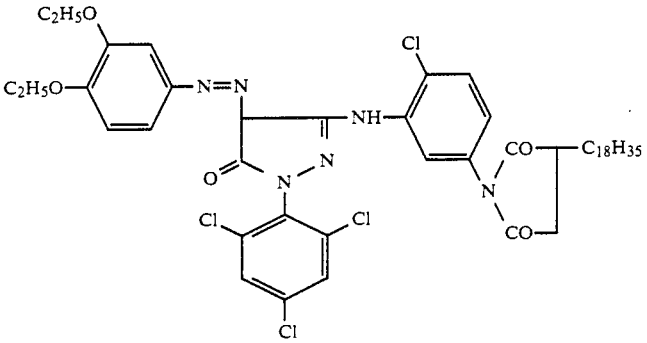
UV-1
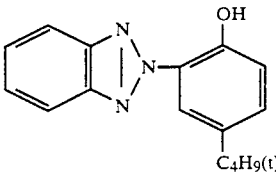
UV-2
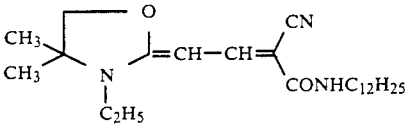
HS-1
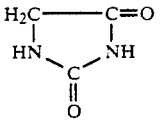
HS-2
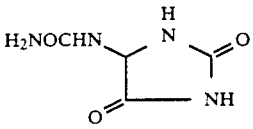
H-1
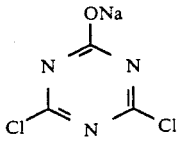
$(CH_2{=}CHSO_2CH_2)_2O$ H-2
SU-1
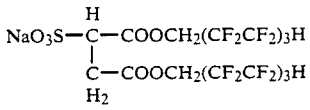

-continued
SU-2
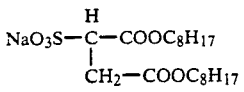
SU-3
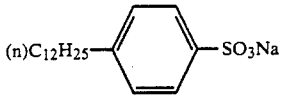
SC-1
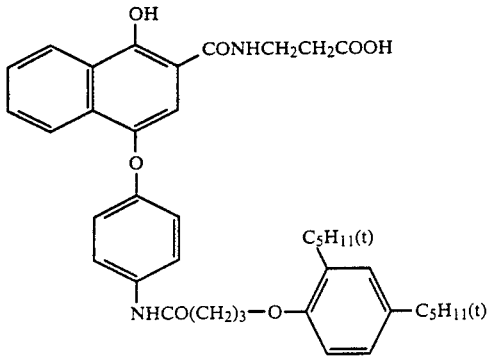
WAX-1
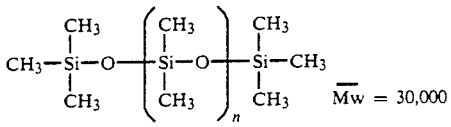
Oil-1
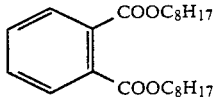
Oil-2
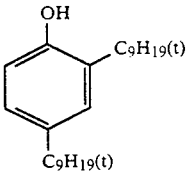
Oil-3
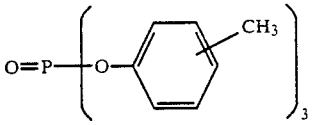
Oil-4
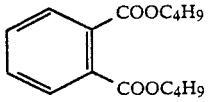
Stab-1
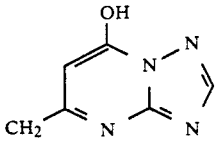
AF-1
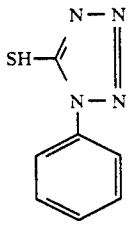

-continued

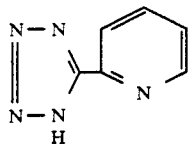

AF-2

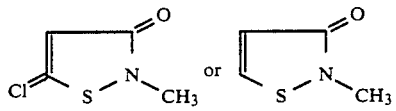

DI-1

Each of the five samples 1 through 5 prepared as mentioned above was exposed wedgewise to white light, and each was then treated in the following processing steps.

Processing step carried out at 38° C.

| | |
|---|---|
| Color developing | 3 minutes and 15 seconds |
| Bleaching | 6 minutes and 30 seconds |
| Washing with water | 3 minutes and 15 seconds |
| Fixing | 6 minutes and 30 seconds |
| Washing with water | 3 minutes and 15 seconds |
| Stabilization | 1 minute and 30 seconds |
| Drying | |

The processing solutions used in the processing steps were as follows

| | |
|---|---|
| <Color developer> | |
| 4-amino-3-methyl-N-ethyl-N-(β-hydroxyethyl) aniline sulfate | 4.75 g |
| Sodium sulfite anhydride | 4.25 g |
| Hydroxylamine ½ sulfate | 2.0 g |
| Potassium carbonate anhydride | 37.5 g |
| Sodium bromide | 1.3 g |
| Trisodium nitrilo-triacetate monohydrate | 2.5 g |
| Potassium hydroxide | 1.0 g |
| Adding water to make one liter. | pH = 10.1 |
| <Bleacher> | |
| Iron-ammonium ethylenediamine tetracetate | 100.0 g |
| Diammonium ethylenediaminetetraacetate | 10.0 g |
| Ammonium bromide | 150.0 g |
| Glacial acetic acid | 10.0 ml |
| Add water to make | 1 liter |
| Adjust pH with aqueous ammonia to | pH = 6.0. |
| <Fixer> | |
| Ammonium thiosulfate | 175.0 g |
| Sodium sulfite anhydride | 8.5 g |
| Sodium metasulfite | 2.3 g |
| Add water to make | 1 liter |
| Adjust pH with acetic acid to | pH = 6.0 |
| <Stabilizer> | |
| Formalin in an aqueous 37% solution | 1.5 ml |
| Konidux (manufactured by KONICA) | 7.5 ml |
| Add water to make | 1 liter |

About the resulting samples, the relative sensitivity S and the grainness level RMS were each measured through green light G. The results are shown in Table-2.

Besides, the twelfth layers of Sample 2, 3 and 4 were coated onto triacetyl cellulose film supports, respectively, and the maximum magenta color densities were each measured in the density measuring method mentioned in the foregoing detailed description of the invention. The results thereof are also shown in Table-2.

The term, relative sensitivity S, means a relative value of the inverse of an exposure quantity which gives a fog density +0.1, provided the green sensitivity G of Sample-1 is regarded as a value of 100.

An RMS value was indicated by 1000 times of the standard deviation of a density value variation produced when the density of the maximum density +1.0 was scanned by the microdensitometer whose scanning aperture is 250 $\mu m^2$. The lower RMS value is, the better the grainness.

TABLE 2

| No. | | Relative sensitivity | RMS | Maximum color density of the twelfth layer |
|---|---|---|---|---|
| 1 | Comparative (Reverse layer) | 100 | 60 | — |
| 2 | Comparative (Reverse layer) | 102 | 63 | 1.05 |
| 3 | Invention (Reverse layer) | 105 | 51 | 0.69 |
| 4 | Invention (Reverse layer) | 101 | 46 | 0.48 |
| 5 | Comparative (Ordinary layer) | 78 | 63 | — |

From Table-2, it is understood that a merit can be got in graininess when the same color sensitive layers are multicoated. In Sample-2, however, the graininess RMS was, on the contrary, deteriorated as compared to Comparative sample-1 having a green sensitive layer divided into two, i.e., the high and low sensitive component layers, though the green sensitivity layer of of this Sample-2 was divided into three component layers, i.e., the high, midium, and low sensitivity layers. In Sample 3-4 of the invention, the remarkable improvement effects could be observed.

Besides, Sample-5 which has not layer composition of the present invention was low in sensitivity and deteriorated in graininess. On the other hand, Samples 3 and 4 each having satisfied the composition of the invention were high in sensitivity and improved on graininess.

EXAMPLE-2

Samples No. 6 through No. 15 of multi-layered color photographic light-sensitive materials were prepared by forming the layers having the following components over a triacetyl cellulose film support, in order from the support side.

Sample-6

The first to eighth layers: The same as those from the first to eighth layers of Sample-1 in Example-1

The ninth layer: The second red sensitive emulsion layer

| | | |
|---|---|---|
| Silver bromoiodide emulsion EM-1 | Amount of silver coated | 0.3 g |
| Silver bromoiodide emulsion EM-5 | Amount of silver coated | 1.0 g |
| Gelatin | | 1.1 g |
| Sensitizing dye S-2 | | $0.3 \times 10^{-4}$ mol per mol of silver |
| Sensitizing dye S-3 | | $1.6 \times 10^{-4}$ mol per mol of silver |
| Coupler C-2 | | 0.12 g |
| Coupler C-1 | | 0.03 g |
| Coupler C-3 | | 0.06 g |
| SC-1 | | 0.03 g |
| High boiling solvent Oil-1 | | 0.24 g |

The tenth layer: The third red sensitive emulsion layer

| | | |
|---|---|---|
| Silver bromoiodide emulsion Em-3 | Amount of silver coated | 1.7 g |
| Fine-grained silver bromoiodide emulsion having an average grain-size of 0.08μ, and an AgI content of 2 mol % | Amount of silver coated | 0.3 g |
| Gelatin | | 1.4 g |
| Sensitizing dye S-2 | | $0.2 \times 10^{-4}$ mol per mol of silver |
| Sensitizing dye S-3 | | $1.0 \times 10^{-4}$ mol per mol of silver |
| Coupler C-2 | | 0.08 g |
| Coupler C-1 | | 0.02 g |
| Coupler C-3 | | 0.04 g |
| SC-1 | | 0.02 g |
| High boiling solvent Oil-1 | | 0.16 g |

The eleventh layer: The same as the tenth layer of Sample-1

The twelfth layer: The second green sensitive emulsion layer.

| | | |
|---|---|---|
| Silver bromoiodide emulsion Em-1 | Amount of silver coated | 0.3 g |
| Silver bromoiodide emulsion Em-5 | Amount of silver coated | 0.8 g |
| Gelatin | | 1.1 g |
| Sensitizing dye S-7 | | $1.0 \times 10^{-4}$ mol per mol of silver |
| Sensitizing dye S-6 | | $1.0 \times 10^{-4}$ mol per mol of silver |
| Sensitizing dye S-8 | | $0.3 \times 10^{-5}$ mol per mol of silver |
| Coupler M-1 | | 0.13 g |
| Coupler CM-1 | | 0.01 g |
| High boiling solvent Oil-2 | | 0.13 g |

The thirteenth layer: The third green sensitive emulsion layer

| | | |
|---|---|---|
| Silver bromoiodide emulsion Em-3 | Amount of silver coated | 1.3 g |
| Gelatin | | 1.7 g |
| Sensitizing dye S-7 | | $0.7 \times 10^{-4}$ mol per mol of silver |
| Sensitizing dye S-6 | | $0.7 \times 10^{-4}$ mol per mol of silver |
| Sensitizing dye S-8 | | $0.2 \times 10^{-5}$ mol per mol of silver |
| Coupler M-1 | | 0.07 g |
| Colored magenta coupler CM-1 | | 0.01 g |
| High boiling solvent Oil-2 | | 0.07 g |

The fourteenth layer: The same as the twelfth layer of Sample-1

The fifteenth layer: The second blue sensitive emulsion layer

| | | |
|---|---|---|
| Silver bromoiodide emulsion EM-1 | Amount of silver coated | 1.0 g |
| Gelatin | | 0.64 g |
| Sensitizing dye S-9 | | $1.0 \times 10^{-4}$ mol per mol of silver |
| Sensitizing dye S-11 | | $3.0 \times 10^{-4}$ mol per mol of silver |
| Coupler Y-1 | | 0.5 g |
| High boiling solvent Oil-3 | | 0.3 g |

The sixteenth layer: The third blue sensitive emulsion layer

| | | |
|---|---|---|
| Silver bromoiodide emulsion (Em-4) | Amount of silver coated | 1.1 g |
| Fine grained silver bromoiodide emulsion having an average grain-size of 0.08μ, and an AgI content of 2 mol % | Amount of silver coated | 0.05 g |
| Fine grained silver bromoiodide emulsion having an average grain-size of 0.3μ, and an AgI content of 2 mol % | Amount of silver coated | 0.05 g |

-continued

| | |
|---|---|
| Gelatin | 1.7 g |
| Sensitizing dye (S-9) | $0.4 \times 10^{-4}$ mol per mol of silver |
| Sensitizing dye (S-11) | $1.2 \times 10^{-4}$ mol per mol of silver |
| Coupler (Y-1) | 0.3 g |
| High boiling solvent Oil-3 | 0.1 g |

The seventh layer: The same as the fourteenth layer of Sample-1

The eighteenth layer: The same as the fifteenth layer of Sample-1

Similar to Sample-1, the additives were added to each layer. Then, DIR compounds were added to the third, fifth, seventh, ninth, tenth, twelfth, thirteenth, fifteenth, and sixteenth layers each of Sample-6 as shown in Table-3, so that Samples No. 7 through No. 14 were prepared. In the columns of Sample Nos. 7 and 8 of Table-3, the amounts of DIR compounds D-50, D-51, and D-52 each added thereto are shown. To the other samples, the DIR compounds were added in the same amount, i.e., an equal mol, as those added to Sample Nos. 7 and 8.

-continued

DIR compounds

D-52

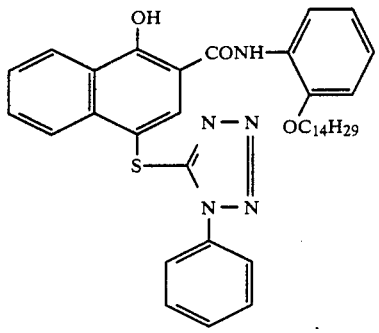

TABLE 3

| No. | | The 3rd layer | The 5th layer | The 7th layer | The 9th layer | The 10th layer | The 12th layer | The 13th layer | The 15th layer | The 16th layer |
|---|---|---|---|---|---|---|---|---|---|---|
| 6 | Inv. | — | — | — | — | — | — | — | — | — |
| 7 | " | D-52 0.005 g | D-50 0.005 g | D-51 0.005 g | — | — | — | — | — | — |
| 8 | " | — | — | — | D-52 0.002 g | D-52 0.001 g | D-52 0.003 g | D-50 0.002 g | D-51 0.002 g | D-51 0.001 g |
| 9 | " | D-52 | D-50 | D-51 | D-52 | D-52 | D-52 | D-50 | D-51 | D-51 |
| 10 | " | D-2 | D-2 | D-2 | — | — | — | — | — | — |
| 11 | " | D-32 | D-32 | D-32 | — | — | — | — | — | — |
| 12 | " | — | — | — | D-32 | D-32 | D-32 | D-32 | D-30 | D-30 |
| 13 | " | — | — | — | D-25 | D-25 | D-6 | D-6 | D-6 | D-6 |
| 14 | " | D-2 | D-2 | D-2 | D-32 | D-32 | D-32 | D-32 | D-30 | D-30 |
| 15 | Comp. | D-2 | D-2 | D-2 | D-32 | D-32 | D-32 | D-32 | D-30 | D-30 |

DIR compounds

D-50

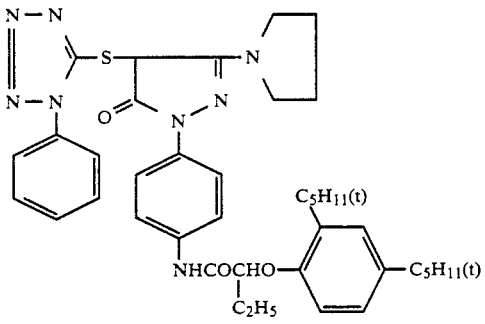

D-51

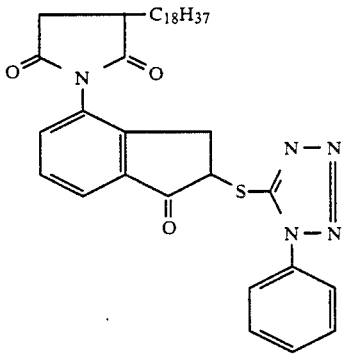

In Sample-15, the following couplers were added to the ninth, tenth, twelfth, thirteenth, fifteenth and sixteenth layers, respectively.

The ninth layer:

| | |
|---|---|
| Coupler C-2 | 0.02 g |
| Coupler C-1 | 0.01 g |
| Coupler C-3 | 0.01 g |
| SC-1 | 0.01 g |
| High boiling solvent Oil-1 | 0.05 g |

The tenth layer:

| | |
|---|---|
| Coupler C-2 | 0.18 g |
| Coupler C-1 | 0.04 g |
| Coupler C-3 | 0.09 g |
| SC-1 | 0.04 g |
| High boiling solvent Oil-1 | 0.35 g |

The twelfth layer:

| | |
|---|---|
| Coupler M-1 | 0.04 g |
| High boiling solvent Oil-2 | 0.04 g |

The thirteenth layer:

| | |
|---|---|
| Coupler M-1 | 0.16 g |

-continued

| | |
|---|---|
| High boiling solvent Oil-2 | 0.16 g |

The fifteenth layer:

| | |
|---|---|
| Coupler Y-1 | 0.25 g |
| High boiling solvent Oil-3 | 0.1 g |

The sixteenth layer:

| | |
|---|---|
| Coupler Y-1 | 0.55 g |
| High boiling solvent Oil-3 | 0.3 g |

Besides, the tenth, thirteenth and sixteenth layers of each of Sample No. 6 and 15 were coated onto triacetyl cellulose film supports, and the maximum color densities were measured in the same manner as in Example-1, respectively. The results thereof are shown in Table-4.

TABLE 4

| No. | | The 10th layer (R) Maximum density | The 13th layer (G) Maximum density | The 16th layer (B) Maximum density |
|---|---|---|---|---|
| 6 | Inv. | 0.46 | 0.48 | 0.56 |
| 15 | Comp. | 1.05 | 1.05 | 1.03 |

Each of samples 6 through 15 prepared as above was wedgewise exposed to white light, then they were developed in the same manner as in Example-1. About the resulting Sample, each of the graininess (RMS) was measured through blue light B. green light G and red light R. Each RMS was measured at the point of a maximum density +0.2 and the minimum density 1.0, in the same manner as in Example-1.

The result is shown in Table-5.

TABLE 5

| Sample No. | | RMS (B) | | RMS (G) | | RMS (R) | |
|---|---|---|---|---|---|---|---|
| | | Min. density +0.2 | Min. density +0.1 | Min. density +0.2 | Min. density +0.1 | Min. density +0.2 | Min. density +0.1 |
| 6 | Inv. | 60 | 57 | 55 | 46 | 48 | 43 |
| 7 | " | 60 | 54 | 54 | 45 | 49 | 42 |
| 8 | " | 58 | 55 | 52 | 44 | 46 | 42 |
| 9 | " | 58 | 53 | 52 | 44 | 46 | 41 |
| 10 | " | 59 | 52 | 53 | 41 | 46 | 39 |
| 11 | " | 58 | 52 | 52 | 40 | 47 | 37 |
| 12 | " | 53 | 53 | 49 | 41 | 41 | 39 |
| 13 | " | 54 | 52 | 50 | 42 | 42 | 40 |
| 14 | " | 51 | 52 | 48 | 38 | 40 | 36 |
| 15 | Comp. | 69 | 65 | 65 | 62 | 55 | 51 |

As shown in Table-5, in the composition of the invention, Samples 10 to 14 each containing dispersion type DIR are more excellent in raininess improvement than Samples 6 to 9 each containing non-dispersion type DIR. Besides, in case of Sample 15 containing dispersion type DIR but not satisfying the composition of the invention, no improvement effect is found.

Every sensitivity of Sample 6 to 15 was equal to or better than that of Sample 4 of Example 1.

What is claimed is:

1. A silver halide color photographic photosensitive material comprising a support and coated thereon at least one green-sensitive silver halide emulsion layer, at least one red-sensitive silver halide emulsion layer, a plurality of blue-sensitive silver halide emulsion layers having different photosensitive speeds, said material further comprising three or more silver halide emulsion layers having substantially the same color sensitivity, a coupler, a diffusible DIR compound in which the diffusibility of a development inhibitor or a development inhibitor-releasable compound which is to be split off upon reaction with the oxidized product of a color developing agent is not less than 0.34, and a low speed red-sensitive emulsion layer, a low speed green-sensitive emulsion layer, a low speed blue-sensitive emulsion layer, followed by a high speed red-sensitive emulsion layer and a medium speed green-sensitive emulsion layer or a medium speed red-sensitive emulsion layer and a high speed red-sensitive emulsion layer, a high speed green-sensitive emulsion layer, and a high speed blue-sensitive emulsion layer provided in that order on the support, wherein the layer with the highest photosensitive speed of said three or more silver halide emulsion layers has a maximum color density of not higher than 1.0.

2. The material of claim 1, wherein the difference in photosensitive speed between the highest photosensitive emulsion layer and the lowest photosensitive emulsion layer in the silver halide emulsion layers having substantially the same color sensitivity is within the range of 0.2 to 2.0 in terms of Log E in which E stands for an exposure.

3. The material of claim 1, wherein the difference in photosensitive speed between the highest photosensitive emulsion layer and the second highest photosensitive emulsion layer in the silver halide emulsion layers having substantially the same color sensitivity is within the range of 0.2 to 1.0 in terms of log E in which E stands for an exposure.

4. The material of claim 1, wherein a yellow filter is provided under at least one layer of a high, medium and low photosensitive blue sensitive emulsion layers.

5. The material of claim 1, wherein a medium speed emulsion layer of the blue sensitive emulsion layers has a maximum color density of 0.3 to 1.5.

6. The material of claim 1, wherein a medium speed emulsion layer of the blue sensitive emulsion layers has a maximum color density of 0.5 to 1.0.

7. The material of claim 1, wherein a medium speed emulsion layer of the green sensitive emulsion layers has a maximum color density of 0.3 to 1.5.

8. The material of claim 1, wherein a medium speed emulsion layer of the green sensitive emulsion layers has a maximum color density of 0.5 to 1.0.

9. The material of claim 1, wherein the highest photosensitive emulsion layer of the blue sensitive emulsion layers has a maximum color density of 0.3 to 0.9.

10. The material of claim 1, wherein the highest photosensitive emulsion layer of the blue sensitive emulsion layers has a maximum color density of 0.4 to 0.8.

11. The material of claim 1, wherein the highest photosensitive emulsion layer of the green sensitive emulsion layers has a maximum color density of 0.2 to 0.8.

12. The material of claim 1, wherein the highest photosensitive emulsion layer of the green sensitive emulsion layers has a maximum color density of 0.3 to 0.6.

13. The material of claim 1, wherein said highest photosensitive emulsion layer of the red sensitive emulsion layers has a maximum color density of 0.2 to 0.8.

14. The material of claim 1, wherein said highest photosensitive emulsion layer of the red sensitive emulsion layers has a maximum color density of 0.3 to 0.6.

15. The material of claim 1, wherein said material comprises a silver halide emulsion layer containing silver halide grains not less than 60% by weight of which have a grain size within the range of ±20% of an average grain size.

16. The material of claim 1, wherein the diffusibility of said DIR compound is not less than 0.40.

17. The material of claim 1, wherein said diffusible DIR compound is represented by Formula D-1, $$A—(Y)m \qquad \text{Formula D-1}$$

wherein A represents a coupler residual group, m is an integer of 1 or 2 and Y represents either a development inhibitor group or a group capable of releasing a development inhibitor, any of which is bonded to the coupling position of the coupler residual group A and is split off upon reaction with an oxidized product of a color developing agent.

18. The material of claim 1, wherein said high speed green sensitive emulsion layer has a maximum color density of 0.3 to 0.6.

* * * * *

UNITED STATES PATENT AND TRADEMARK OFFICE

CERTIFICATE OF CORRECTION

PATENT NO. : 5,034,310

DATED : July 23, 1991

INVENTOR(S) : Hiroshi Ikeda et al

It is certified that error appears in the above-identified patent and that said Letters Patent is hereby corrected as shown below:

Claim 2, column 42, line 36, change "Log" to --log--.

Signed and Sealed this

Sixteenth Day of March, 1993

*Attest:*

STEPHEN G. KUNIN

*Attesting Officer*

*Acting Commissioner of Patents and Trademarks*